United States Patent [19]

Bland

[11] Patent Number: 4,679,980

[45] Date of Patent: Jul. 14, 1987

[54] GRAVITY INSENSITIVE INVENTORY CONTROL DEVICE FOR A TWO-PHASE FLOW SYSTEM

[75] Inventor: Timothy J. Bland, Rockford, Ill.

[73] Assignee: Sundstrand Corporation, Rockford, Ill.

[21] Appl. No.: 686,982

[22] Filed: Dec. 27, 1984

[51] Int. Cl.[4] ..... B04B 11/02; B01D 19/00

[52] U.S. Cl. ..... 415/24; 415/88; 494/3; 494/10; 55/21; 55/52

[58] Field of Search ..... 415/88, 89, 24, 26, 415/49, 118; 494/2, 3, 10, 55, 56; 55/21, 52

[56] References Cited

U.S. PATENT DOCUMENTS

| | | | |
|---|---|---|---|
| 2,124,914 | 7/1938 | Fottinger | 415/89 |
| 2,557,345 | 6/1951 | Francki | 415/24 X |
| 2,811,925 | 11/1957 | Crookston | 417/386 |
| 3,093,080 | 6/1963 | Tarifa et al. | 415/24 |
| 3,341,093 | 9/1967 | Putterlik | 494/3 |
| 3,817,659 | 6/1974 | Erickson et al. | 417/84 |
| 3,936,214 | 2/1976 | Zupanick | 415/89 |
| 3,966,117 | 6/1976 | Johannes | 494/10 |
| 3,994,618 | 11/1976 | Erickson | 415/89 |
| 4,267,964 | 5/1981 | Williams | 494/52 |
| 4,516,987 | 5/1985 | Niggemann | 55/52 |
| 4,557,719 | 12/1985 | Neumann et al. | 494/3 X |

*Primary Examiner*—Robert E. Garrett
*Assistant Examiner*—Joseph M. Pitko
*Attorney, Agent, or Firm*—Wood, Dalton, Phillips, Mason & Rowe

[57] ABSTRACT

An inventory control device for a pitot pump used in a two-phase flow system, such as a closed-cycle Rankine system or a two-phase cooling loop for space vehicles. In these systems, there is a change of phase between liquid and vapor, dependent upon a change of power level or thermal transport rate. With these systems being used in devices that are subject to significant attitude change or acceleration forces or zero gravity conditions, the inventory control device is gravity insensitive and utilizes a second tube mounted in the pitot pump which is connected to an external accumulator. A pressure relation is established whereby the second tube will maintain a constant level of liquid within the rotating drum of the pitot pump.

12 Claims, 3 Drawing Figures

GRAVITY INSENSITIVE INVENTORY CONTROL DEVICE FOR A TWO-PHASE FLOW SYSTEM

DESCRIPTION

1. Technical Field

This invention relates to an inventory control device for a flow system which is gravity insensitive and, more particularly, to an inventory control device for a two-phase flow system wherein a liquid changes to and from a vapor state. The inventory control device has particular utility with flow systems which operate with significant attitude change, or encounter significant acceleration forces or have to operate in the zero gravity condition of space. Examples of such systems are a steam Rankine power system for a torpedo where significant changes in attitude and power level occur, two-phase cooling systems as used in space vehicles where very large turn-down ratios are demanded and organic Rankine cycle power systems for space applications.

2. Background Art

There are certain thermodynamic cycles which employ a change of phase from liquid to vapor and back to liquid during their operation. Two examples of such thermodynamic cycles are the closed-cycle Rankine system and the two-phase cooling loop. In both of these thermodynamic cycles, liquid is pressurized in a pump and flows to an evaporator where thermal energy is absorbed and vapor generated. The vapor then flows to a condenser where thermal energy is released and the vapor recondensed to liquid to complete the cycle.

When the power level of the closed-cycle Rankine system or the thermal transport rate of a two-phase cooling loop is varied, the relative amounts of liquid and vapor in the two-phase regions of the thermodynamic cycle varies and inventory control must be provided to compensate for the changes in the amount of liquid. For example, when a closed-cycle Rankine power system is operating at high power, more liquid is needed in the system than at low power.

Stationary terrestrial systems can employ a reservoir as a hot-well for inventory storage under earth gravity conditions. However, a system using a thermodynamic cycle of this type, which is subject to significant change of attitude or significant acceleration forces, such as a steam Rankine power system for a torpedo, requires the use of inventory control techniques which are gravity independent. Another system which requires the use of such inventory control techniques is a two-phase cooling system for a space vehicle where very large turn-down ratios are demanded. The thermal transport rate can have a large turn-down ratio because of the variations in heat generated by operation of equipment in the vehicle.

It is known to pressurize liquid by means of a pitot pump and direct the pressurized liquid flow to an evaporator where thermal energy is absorbed and vapor generated. A pitot pump utilizes a rotating drum and a stationary pitot tube having an inlet which is positioned near the wall of the rotating drum and submerged in the liquid within the pump. The pitot pump can operate perfectly satisfactorily with a vapor space located at the core of the drum. The pitot tube collects the pressurized liquid which has a pressure resulting from both dynamic and static pressures. With the pitot pump being in a closed loop, the ratio between liquid and vapor in the system can vary, dependent upon the change in power level of the closed-cycle Rankine system or the change in thermal transport rate in the two-phase cooling loop. Although the pitot pump rotating drum could be built of a size to hold varying levels of liquid required during different phases of operation, this is undesirable in many situations because of possible adverse effects. A liquid level in the rotating drum of a pitot pump has a certain inertia and this inertia varies with the liquid level and each different inertia results in a different momentum. This varying momentum, dependent upon the liquid level, can have an adverse gyroscopic effect upon a change of attitude of a space vehicle or torpedo. If the liquid level within the rotating drum of the pitot pump can be maintained constant, there is then a constant inertia and, therefore, a constant momentum and one variable in the directional control of the space vehicle or torpedo is removed.

The invention to be described hereinafter enables the use of a pitot pump in systems having thermodynamic cycles which employ a change of phase between liquid and vapor which is desirable because of the capability of the pitot pump to operate at zero net positive suction head without there being a cavitation problem. The invention provides means associated with the pitot pump to maintain a constant liquid level in the pitot pump for inventory control.

DISCLOSURE OF THE INVENTION

The invention relates to a flow system utilizing a pitot pump for pressurizing a liquid, with means for maintaining a predetermined liquid level in the rotating drum of the pitot pump. This result is achieved by the use of an additional tube within the rotating drum of the pitot pump which is connected with an accumulator having a predetermined back pressure and with there being flow between the pitot pump and the accumulator, dependent upon the pressure relation between the pressure at the accumulator and the pressure at the inlet to the additional tube.

More particularly, the invention relates to a gravity insensitive inventory control device associated with a pitot pump used in a two-phase flow system.

In the two-phase flow system, there is a thermodynamic cycle wherein there is a change of phase between liquid and vapor during operation. Examples of such systems are the closed-cycle Rankine system and the two-phase cooling loop for space vehicle applications. In both cases, the pitot pump pressurizes liquid which flows to an evaporator where thermal energy is absorbed and there is a change of phase from liquid to vapor. The vapor then flows to a condenser where thermal energy is released and the vapor is recondensed to a liquid to complete the cycle. When the power level of the closed cycle Rankine system or the thermal transport rate of the two-phase cooling loop is varied, the relative amounts of liquid and vapor in the two-phase regions of the cycle vary and the invention disclosed herein provides for inventory control to compensate for the change.

The inventory device disclosed herein is gravity insensitive whereby the inventory control provided at the pitot pump can enable use of the pitot pump in a flow system which is subject to operation with significant attitude change or significant acceleration forces, such as encountered in a steam Rankine power system for a torpedo or in the zero gravity conditions of space, such as wherein the flow system is a two-phase space cooling system. In the latter instance, very large turn-down ratios are demanded with resulting wide variations in the relative amounts of liquid and vapor in the two-phase regions of the thermodynamic cycle.

A primary feature of the invention is to provide a gravity insensitive inventory control device for a two-phase flow system by a simple addition to a pitot pump used in the flow system.

An object of the invention is to provide inventory control structure for maintaining a predetermined liquid level in a pitot pump which pressurizes liquid in a two-phase flow system.

More particularly, the inventory control structure utilizes an accumulator in flow communication with an added tube in the pitot pump and which has an opening located at a desired liquid level in the rotating drum of the pitot pump. The added tube can be a pitot tube or a radially outward facing tube. The accumulator is pressurized to establish a reference pressure at the opening of the added tube whereby a pressure at the opening in excess of the reference pressure will cause flow of liquid to the accumulator and there will be liquid flow from the accumulator when the pressure at the opening is less than the reference pressure.

Still another object of the invention is to enhance the utilization of a pitot pump in flow systems having a change of phase between liquid and vapor by maintaining a constant amount of liquid within the rotating drum of the pitot pump whereby the inertia of the liquid and the momentum resulting therefrom are maintained constant to avoid a varying gyroscopic effect upon the change of attitude of a device, such as a space vehicle or a torpedo which utilizes the two-phase flow system.

A further object of the invention is to provide a gravity insensitive inventory control device in association with a pitot pump which receives both liquid and vapor and which pumps pressurized liquid to an evaporator, such as used in a closed-cycle Rankine system or a two-phase cooling loop. The pitot pump has a rotating drum in which a stationary pitot tube is positioned for pumping liquid to the evaporator. There is a vapor core within an annulus of liquid carried by the rotating drum and the interface between the vapor core and the liquid level may vary dependent upon the power demanded in the closed-cycle Rankine system or the thermal transport rate in the two-phase cooling loop. Inventory control is provided by an additional tube having an opening within the rotating drum at a desired interface location between the liquid and vapor core and which is connected to an accumulator which is pressurized by the pressure of the vapor within the vapor core. An increase in the amount of liquid within the rotating drum will increase the liquid annulus and decrease the diameter of the vapor core and the static pressure at the opening of the second tube will increase to a value above vapor pressure and liquid will flow from the rotating drum to the accumulator. When the second tube opening is uncovered by an increase in the diameter of the vapor core, the back pressure in the accumulator will cause liquid to flow from the accumulator into the system. The inventory control device functions to maintain a constant liquid level in the rotating drum and at equilibrium the second tube will generate just enough pressure to balance the pressure requirement of the accumulator.

A further object of the invention is to provide a flow system utilizing a pitot pump for receiving a two-phase fluid flow and separating the fluid into a vapor core and a surrounding annulus of liquid with delivery of pressurized liquid therefrom, and means for maintaining the inner surface of the liquid annulus at a constant level.

Still another object of the invention is to provide an inventory control device for a flow system which is gravity insensitive comprising: a pitot pump having a rotating drum with a fluid inlet centrally thereof, a pitot tube mounted within said drum and which is stationary relative thereto and having an inlet near the outer periphery of said rotating drum, and a liquid outlet connected to said pitot tube for delivery of liquid from the pitot pump; a fluid storage device in which liquid is stored under pressure; a second tube having an opening positioned intermediate an axis of rotation of said drum and said pitot tube inlet; and a flow connection between said second tube and the fluid storage device whereby fluid can flow either to or from said fluid storage device dependent upon the relation between the fluid storage pressure and the fluid pressure at the second tube opening.

BEST MODE FOR CARRYING OUT THE INVENTION

Figure 1:
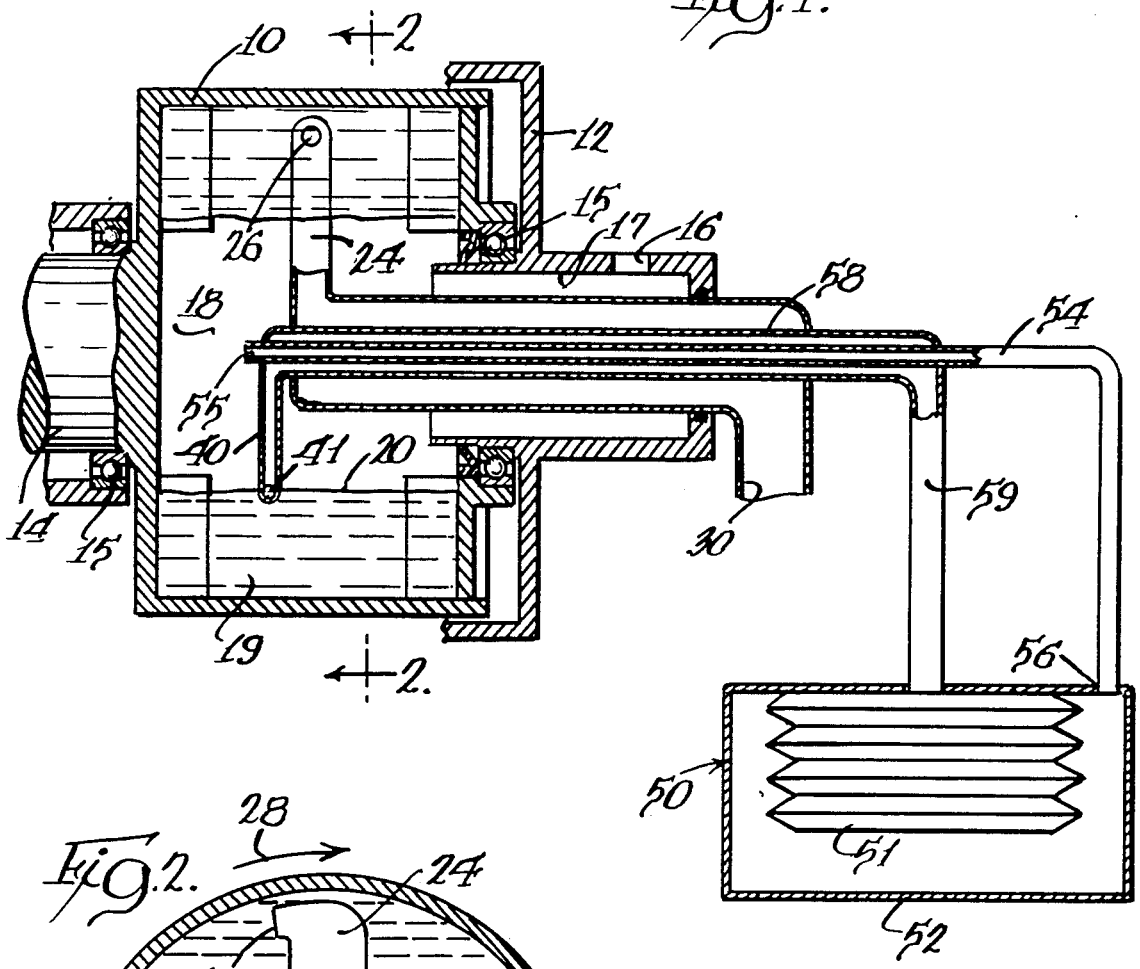
FIG. 1 is a schematic view of a pitot pump having the inventory control device associated therewith.
Figure 2:
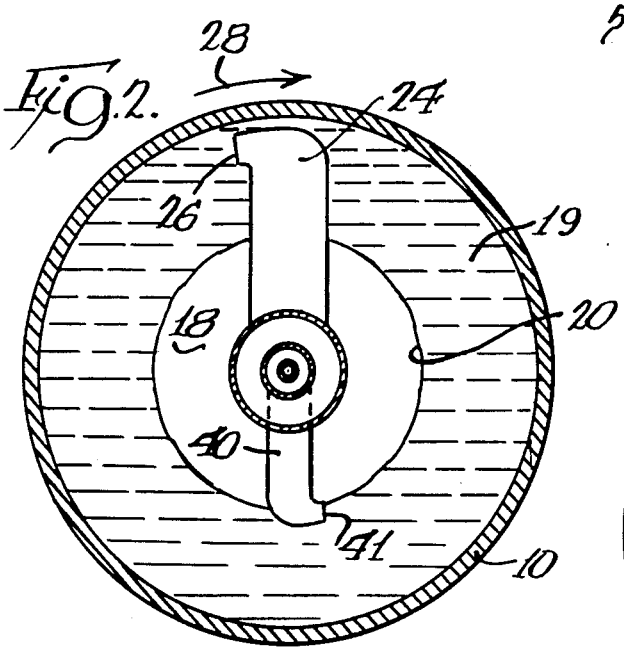
FIG. 2 is a section taken generally along the line 2—2 in FIG. 1.

The pitot pump is shown generally in FIGS. 1 and 2. The pitot pump is usable in a two-phase flow system, such as a closed-cycle Rankine system or a two-phase cooling loop and is particularly advantageous because of its ability to operate at zero net positive suction head and to provide a constant liquid pressure at the outlet of the pump to ease the design of the over-all system. The pitot pump has a rotating drum 10 rotatable within a casing, shown fragmentarily at 12, and which is driven by a shaft 14 connected to a suitable power source and which defines an axis of rotation. The shaft 14 and rotating drum 10 are supported by bearings 15. An inlet 16 receives fluid from a condenser of the flow system and the fluid flows through passage 17 to the interior of the rotating drum 10. When inlet pressure to the pump is reduced, a point is reached at which a vapor core 18 will form in the pump. The liquid is caused to form a liquid annulus 19 extending inwardly from the peripheral wall of the drum resulting from centrifugal force derived from drum rotation, with the vapor core being located interiorly thereof. The interface between the vapor core 18 and the liquid annulus is indicated by a line 20.

The rotating drum 10 is rotated at a high speed by the driven shaft 14 and the liquid pressure in the liquid annulus increases radially outwards due to the rotation. A conventional pitot tube 24 is stationarily mounted within the rotating drum 10 and has an inlet 26 facing oppositely to the direction of rotation of the drum 10, as indicated by the arrow 28 in FIG. 2. The pitot tube 24 collects the pressurized liquid, with the liquid pressure being both a static pressure and a dynamic pressure associated with the relative velocity between the rotating liquid and the pitot tube 24. The pitot tube 24 connects to an outlet passage 30. The foregoing structure of the pitot pump is well known in the art.

When the vapor core 18 exists within the pitot pump, the pump is operating in a vapor-core mode and the outlet pressure of the liquid is dependent on the difference in level between the vapor core, as defined at the interface 20, and the tube inlet 26. The pump is then operating with zero net positive suction head.

Figure 3:
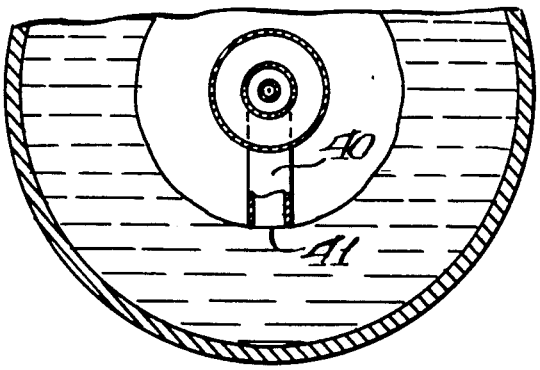
FIG. 3 is a partial section similar to FIG. 2 showing a modified embodiment.

The inventory control device which is gravity insensitive comprises a second tube 40 having an opening 41 facing the rotating liquid or, alternatively, the opening can face radially outward, as seen in FIG. 3. The opening 41 is positioned to maintain a constant level for the vapor core and resultingly obtain a constant level of liquid. This result is achieved by associating the second tube 40 with an accumulator, indicated generally at 50 which, in the illustrative example, has a bellows 51 mounted within a casing 52. The exterior of the bellows is exposed to vapor pressure in the vapor core by means of a tube 54 having an end 55 positioned within the vapor core and an opposite end 56 connected to the casing 52. The bellows 51 is thereby referenced to the vapor pressure within the vapor core. Alternatively, the casing 52 could be evacuated and a spring positioned therein in contact with the bellows to provide a force to balance the pressure generated by the second tube 40.

The second tube 40 is connected to the interior of the bellows by a tube 58 surrounding the tube 54 and a connecting tube 59.

In the system as shown, with the bellows referenced to vapor core pressure, the level of liquid within the rotating drum can be maintained at a constant level. When operation of the two-phase system tends to reduce the amount of liquid required in the flow system, the liquid level in the rotating drum 10 will move towards the center line. This would occur in the closed cycle Rankine system when there is a reduced power demand and in a two-phase cooling loop when there is a relatively low thermal transport rate. As the liquid level moves toward the center line of the rotating drum 10, the second tube 40 will generate additional static pressure and pump the excess liquid into the accumulator 50 against the spring force of the bellows 51. When the flow system demands more liquid, the liquid level within the rotating drum 10 will move outwardly and uncover the opening 41 of the second tube 40. In this case, the second tube 40 cannot support the back pressure in the accumulator 50 and liquid will flow from the accumulator through the tubes 58 and 59 and the second tube 40 back into the rotating drum 10. At equilibrium, the second tube 40 will generate just enough pressure to balance the pressure requirement of the accumulator.

The opening 41 of the second tube 40 is set to establish a liquid level in the rotating drum for the desired pressurization of the liquid being pumped by the pitot pump.

The gravity insensitive inventory control device functions to maintain a constant liquid level in the pitot pump whereby the inertia thereof as well as the resulting momentum are known and excess liquid as may be required during certain times of operation can be stored in an accumulator for flow into the system as required. The pressurization of the accumulator and the relation thereof to a pressure within the pitot pump renders the system insensitive to gravity and enables use with flow systems which encounter significant attitude change or suffer significant acceleration forces and without any adverse effect on the control of a device utilizing the flow system.

I claim:

1. An inventory control device for a flow system which is gravity insensitive comprising: a pitot pump having a rotating drum with a fluid inlet centrally thereof, a pitot tube mounted within said drum and which is stationary relative thereto and having an inlet near the outer periphery of said rotating drum, and a liquid outlet connected to said pitot tube for delivery of liquid from the pitot pump; a fluid storage device in which liquid is stored under pressure; a second tube having an opening positioned intermediate an axis of rotation of said drum and said pitot tube inlet; and a continuously open flow connection between said second tube and the fluid storage device whereby fluid can flow either to or from said fluid storage device dependent upon the relation between the fluid storage pressure and the fluid pressure at the second tube opening.

2. An inventory control device as defined in claim 1 wherein said fluid delivered to said rotating drum is a mixture of liquid and vapor with the rotating drum causing separation of one from the other, said pressure at which fluid is stored in the fluid storage device is the pressure of the vapor in the rotating drum, and said second tube opening is positioned at a location to determine the inner level of liquid carried in the rotating drum.

3. An inventory control device as defined in claim 1 wherein said fluid storage device is an accumulator.

4. An inventory control device as defined in claim 1 wherein said fluid storage device has a casing with a bellows therein connected to said flow connection to the second tube, and said casing is connected to a source of pressure.

5. An inventory control device as defined in claim 4 wherein said fluid in the drum includes an outer layer of liquid and a vapor core within said layer of liquid, and said vapor core is the source of pressure for said casing.

6. An inventory control device for a flow system which is gravity insensitive comprising: a pitot pump having a rotating drum with a fluid inlet centrally thereof with fluid delivered to said rotating drum being a mixture of liquid and vapor with the rotating drum causing separation of one from the other, a pitot tube mounted within said drum and having an inlet near the outer periphery of said rotating drum, and a liquid outlet connected to said pitot tube for delivery of liquid from the pitot pump; a fluid storage device in which liquid is stored under pressure said pressure at which fluid is stored in the fluid storage device is the pressure of the vapor in the rotating drum; a second tube having an opening positioned intermediate an axis of rotation of said drum and said pitot tube inlet; and a continuously open flow connection between said second tube and the fluid storage device whereby fluid can flow either to or from said fluid storage device dependent upon the relation between the fluid storage pressure and the fluid pressure at the second tube opening, and said second tube opening is positioned at a location to determine the inner level of liquid carried in the rotating drum.

7. An inventory control device as defined in claim 6 wherein said fluid storage device is an accumulator.

8. An inventory control device as defined in claim 6 wherein said fluid storage device has a casing with a bellows therein connected to said flow connection to the second tube, and said casing is connected to the center of the rotating drum to be subject to said vapor pressure.

9. A device for controlling liquid inventory in a flow system wherein said liquid changes phase to a vapor and back and a pitot pump including a pitot tube separates vapor from liquid and pumps the liquid to a component of the flow system comprising, a pressurized accumulator for liquid, a second tube associated with the pitot pump, a continuously open two-way flow connection between the second tube and the pressurized accumulator, and said second tube having an opening positioned within the pitot pump at a location to establish a desired liquid level in the pitot pump and at which level the pressure at the second tube inlet will equal the liquid pressure in the pressurized accumulator.

10. A liquid inventory control device as defined in claim 9 wherein the pressure at the pressurized accumulator is the pressure of the vapor in the pitot pump, and said second tube opening is located at the desired inner surface level of liquid in the pitot pump.

11. A liquid inventory control device for a flow system wherein said liquid changes phase to a vapor and back and a pitot pump separates vapor from liquid and pumps the liquid to a component of the flow system comprising, a liquid storage device for storing liquid under pressure, a tube positioned within the pitot pump and in open communication with the liquid storage device, and said tube having an opening positioned within the pitot pump at a location to establish a desired liquid level in the pitot pump and at which level the pressure at the pitot tube inlet will equal the liquid pressure at the liquid storage device.

12. A liquid inventory control device as defined in claim 11 wherein the pressure at the liquid storage device is the pressure of vapor in the pitot pump, and said tube opening is located at the desired inner surface level of liquid in the pitot pump.

* * * * *